US009445669B2

(12) United States Patent
Li et al.

(10) Patent No.: US 9,445,669 B2
(45) Date of Patent: Sep. 20, 2016

(54) COMBINED SHELF STRUCTURE AND REFRIGERATION EQUIPMENT

(71) Applicant: Hisense Ronshen (Guangdong) Freezer Co., Ltd., Foshan, Guangdong (CN)

(72) Inventors: Yangsong Li, Guangdong (CN); Guoliang Chen, Guangdong (CN); Kai Cheng, Guangdong (CN); Yuehai Xu, Guangdong (CN); Bo Yang, Guangdong (CN); Songshan Pan, Guangdong (CN)

(73) Assignee: HISENSE RONSHEN (GUANGDONG) FREEZER CO., LTD., Foshan, Guangdong (CN)

( * ) Notice: Subject to any disclaimer, the term of this patent is extended or adjusted under 35 U.S.C. 154(b) by 0 days.

(21) Appl. No.: 14/851,683

(22) Filed: Sep. 11, 2015

(65) Prior Publication Data

US 2016/0037917 A1 Feb. 11, 2016

Related U.S. Application Data

(63) Continuation of application No. PCT/CN2015/070313, filed on Jan. 8, 2015.

(30) Foreign Application Priority Data

Aug. 7, 2014 (CN) ..... 2014 1 0387806

(51) Int. Cl.
*A47B 47/00* (2006.01)
*A47B 73/00* (2006.01)
(Continued)

(52) U.S. Cl.
CPC ..... *A47B 73/008* (2013.01); *A47B 73/006* (2013.01); *A47B 96/021* (2013.01);
(Continued)

(58) Field of Classification Search
CPC .... A47B 47/00; A47B 73/00; A47B 73/008; A47B 73/006; A47B 96/021; A47B 96/027; F25D 25/02; F25D 2325/021; F25D 2331/803; F25D 2331/805
USPC ..... 211/74, 153, 134; 108/64, 67, 90, 102, 108/180; 312/408
See application file for complete search history.

(56) References Cited

U.S. PATENT DOCUMENTS 2,453,667 A * 11/1948 Lambert ..... F25D 11/00 211/74
2,724,630 A * 11/1955 Saunders ..... F25D 25/024 312/408

(Continued)

FOREIGN PATENT DOCUMENTS

CN 101063584 A 10/2007
CN 104180602 A 12/2014

(Continued)

OTHER PUBLICATIONS

International Search Report for corresponding Application No. PCT/CN2015/070313 dated May 15, 2015.

*Primary Examiner* — Joshua J Michener
*Assistant Examiner* — Devin Barnett
(74) *Attorney, Agent, or Firm* — Renner, Otto, Boisselle & Sklar, LLP.

(57) ABSTRACT

The invention relates to the technical field of a refrigerator or a wine refrigerator, and more particularly relates to a combined shelf structure. The combined shelf structure is arranged in a wine refrigerator. The combined shelf structure comprises at least two shelf bodies and at least two carrier bars. Connecting holes through which two carrier bars pass are respectively arranged at both ends of each shelf body. Either the top surface or the bottom surface of the shelf body is provided with a groove, and the remaining surface is provided with a flat structure. The carrier bars pass through the connecting holes. The shelf body with a top surface and a bottom surface which is different from the top surface provides choices to users for placing wine bottles or other canned and bottled drinks vertically or horizontally. Further the arrangement of connecting holes through which the carrier bars pass enables the shelf bodies to be suspended on the carrier bars, and hence the shelf bodies are easy to be disassembled and convenient to be arranged in a reasonable way according to the real placement requirements for objects.

16 Claims, 3 Drawing Sheets

(51) Int. Cl.
*F25D 25/02* (2006.01)
*A47B 96/02* (2006.01)

(52) U.S. Cl.
CPC ..... *F25D 25/02* (2013.01); *A47B 47/00* (2013.01); *A47B 73/00* (2013.01); *A47B 96/027* (2013.01); *F25D 2325/021* (2013.01); *F25D 2331/803* (2013.01); *F25D 2331/805* (2013.01)

(56) References Cited

U.S. PATENT DOCUMENTS 2,975,908 A * 3/1961 Huet ..... A47B 96/028 108/185
3,199,684 A * 8/1965 Bradley ..... B01L 9/06 108/92
3,513,786 A * 5/1970 Kellogg ..... A47B 96/021 108/152
3,606,023 A * 9/1971 Edmunds ..... A47B 73/006 211/194
3,770,106 A * 11/1973 Kuehl ..... B65G 17/06 108/67
3,832,957 A * 9/1974 Mendenhall ..... A47B 96/025 108/108
4,506,796 A * 3/1985 Thompson ..... A47B 81/007 108/55.3
5,370,245 A * 12/1994 Tersch ..... A47B 73/006 211/194
5,809,905 A * 9/1998 John ..... B65D 19/0018 108/56.1
6,439,280 B1 * 8/2002 Wang ..... B23D 47/025 108/64
D499,284 S * 12/2004 Rafoth ..... D6/513
6,981,597 B2 * 1/2006 Cash ..... A47B 73/008 211/74
8,376,154 B2 * 2/2013 Sun ..... A47F 1/125 193/35 J
9,028,020 B2 * 5/2015 Gossens ..... A47B 73/00 312/408
2004/0135481 A1 * 7/2004 Diebold ..... A47B 73/00 312/408
2004/0160151 A1 * 8/2004 Collins ..... F25D 25/02 312/404
2004/0174108 A1 * 9/2004 Benitsch ..... F25D 25/024 312/408
2004/0250739 A1 * 12/2004 Yang ..... A47B 1/06 108/67
2007/0228909 A1 * 10/2007 Hwang ..... F25D 25/024 312/408
2007/0228911 A1 * 10/2007 Kim ..... F25D 23/067 312/408
2007/0266911 A1 * 11/2007 Lee ..... A47B 25/00 108/64
2008/0034778 A1 * 2/2008 Lim ..... F25D 25/02 62/340
2009/0232632 A1 * 9/2009 Baltz ..... B65D 19/0002 414/800
2011/0094980 A1 * 4/2011 Cousin ..... A47F 5/005 211/59.2
2011/0132853 A1 * 6/2011 Drobot ..... A47B 57/562 211/42
2014/0284289 A1 * 9/2014 Perez ..... A47B 3/00 211/49.1
2014/0339182 A1 * 11/2014 Koder ..... A47B 73/00 211/75
2014/0360120 A1 * 12/2014 Brisendine ..... E04F 15/02405 52/582.1
2015/0076985 A1 * 3/2015 Yoo ..... F25D 25/02 312/408
2015/0091430 A1 * 4/2015 Popovitch ..... F25D 25/021 312/408
2015/0253064 A1 * 9/2015 Kim ..... F25D 25/02 312/408
2015/0338157 A1 * 11/2015 Lim ..... F25D 23/062 312/408

FOREIGN PATENT DOCUMENTS

EP 2 375 203 A2 10/2011
FR 2 929 812 A1 10/2009

* cited by examiner

COMBINED SHELF STRUCTURE AND REFRIGERATION EQUIPMENT

CROSS-REFERENCE TO RELATED APPLICATIONS AND PRIORITY CLAIM

This application claims the benefit and priority of Chinese Patent Application No. 201410387806.0, FILED ON Aug. 7, 2014 and entitled A Combined Shelf Structure, which is hereby incorporated by reference herein in its entirety. This application also claims the benefit and priority of Patent Cooperation Treaty Patent Application No. PCT/CN2015/070313, filed Jan. 8, 2015, which is hereby incorporated by reference herein in its entirety.

FIELD

The invention relates to the technical field of refrigerators and wine refrigerators, and more particularly, relates to a combined shelf structure.

BACKGROUND

With the development of technology, the requirement for a long-term preservation of foods has been satisfied by various devices. Examples of such devices are represented by refrigerators, wine refrigerators or other refrigeration equipments, which serve as the most popular equipment for storing foods and drinks. The inner of these refrigeration equipments are all provided with shelf structures on which foods or drinks rest. Many types of shelf structures have been developed specifically dedicated to meet the requirement of placing different kinds of wine bottles, canned or bottled drinks. However, there still exist other situations where the users' diverse needs cannot be satisfied by the aforesaid shelf structures due to their own shortcomings.

As can be seen from the FIG. 1, it is an example of traditional shelf structure which is arranged in most refrigerators or wine refrigerators for placement of wine bottles and other canned or bottled drinks. One side of the shelf structure is provided with a flat for vertically holding wine bottles and other canned or bottled drinks, and the other side of the shelf structure is provided with grooves for horizontally receiving the wine bottles and other canned or bottled drinks. However, both sides of the shelf structure are formed in one piece. When the flat side is used, wine bottles cannot be put horizontally on it; while when the grooved side is used, it is not favorable for resting other kinds of objects on the bumpy surface, and especially when few wine bottles need to be stored, a large part of the space of the refrigeration equipment is wasted.

SUMMARY OF THE INVENTION

In one embodiment of the present disclosure, a combined shelf structure is provided therefore to overcome at least one shortcoming described above. Horizontal placement of wine bottles and other canned or bottled drinks, and vertical placement thereof can be fulfilled by a shelf body with a top surface and a bottom surface which is different from the top surface In one aspect of the present disclosure, a combined shelf structure which is positioned in a wine refrigerator comprises at least two shelf bodies and at least two carrier bars; connecting holes through which the two carrier bars pass are respectively arranged at both ends of each shelf body, either the top surface or the bottom surface of the shelf body is provided with grooves, the remaining surface is provided with a flat structure; and the carrier bars pass through the connecting holes.

In another aspect of the present disclosure, a refrigerator equipment is provided, which comprises a shelf structure, wherein the shelf structure comprises at least two shelf bodies and at least two carrier bars; connecting holes through which the two carrier bars pass are respectively arranged at both ends of each shelf body, either the top surface or the bottom surface of the shelf body is provided with grooves, the remaining surface is provided with a flat structure; and the carrier bars pass through the connecting holes.

DETAILED DESCRIPTION OF THE EMBODIMENTS

The invention will now be described more fully hereinafter with reference to the accompanying drawings, in which exemplary embodiments of the invention are shown. It will be understood that the figures are merely provided for exemplary illustrations rather than being served to show the real product, and therefore the invention should not be limited by those figures. Some parts of the figures may be neglected, enlarged or reduced for better interpretations of the embodiments, so the figures do not present the real size of real products. For the skilled in the field, he/she shall understand that some of the known structures of the figures and the descriptions thereof may be omitted.

Wherever possible, the same or like reference numbers used throughout the embodiments of the present disclosure refer to the same or like elements. It will be understood that the terms indicating orientations or position relationships, such as "up", "down", "left" and "right" are based on the figures, and they are only used for describing the present disclosure and simplifying the illustration, which should not be construed as indicating or implying that the device or element has a specified orientation, or configured and operated in a specified orientation. Thus the terms used for describing position relationships herein are illustrative only, and in no way limit the scope of the invention. It will be appreciated for the skilled in the field to understand the specific meaning of those terms in accordance with specific conditions.

Embodiment 1

Figure 1:
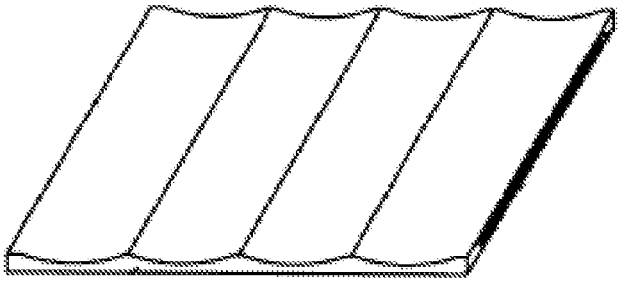
FIG. 1 is a structure schematic view of the shelf structure of the prior art.
Figure 2:
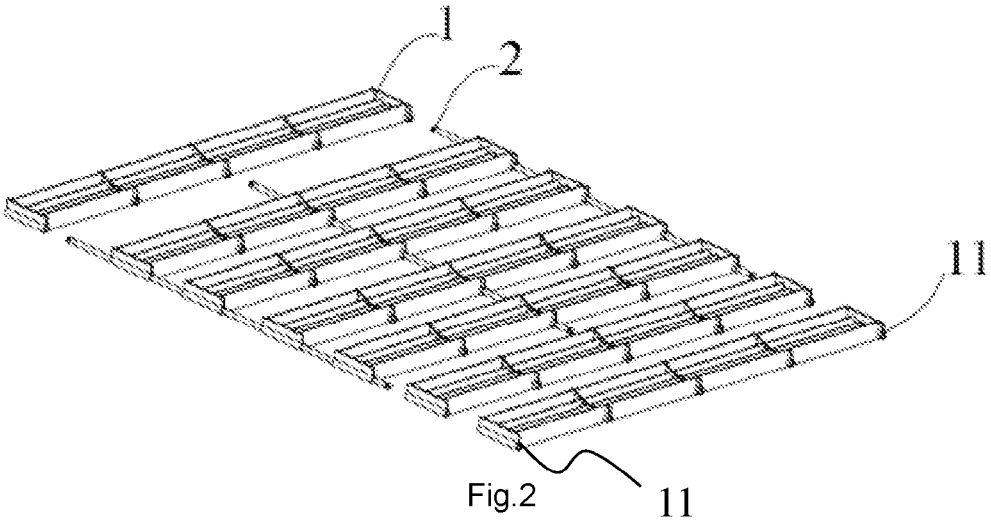
FIG. 2 is an exploded schematic view of the combined shelf structure of embodiment 1.
Figure 3:
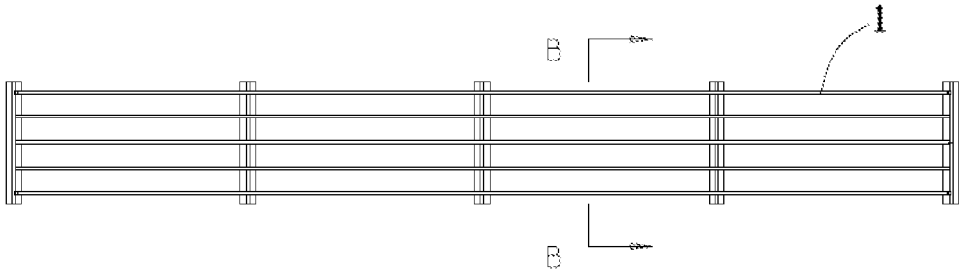
FIG. 3 is a structure schematic view of the shelf body.
Figure 4:
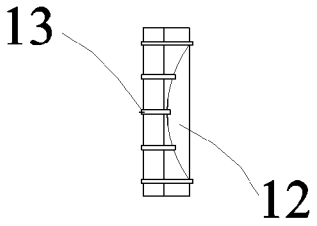
FIG. 4 is a schematic view seen from the line B-B direction of FIG. 3.
Figure 5:
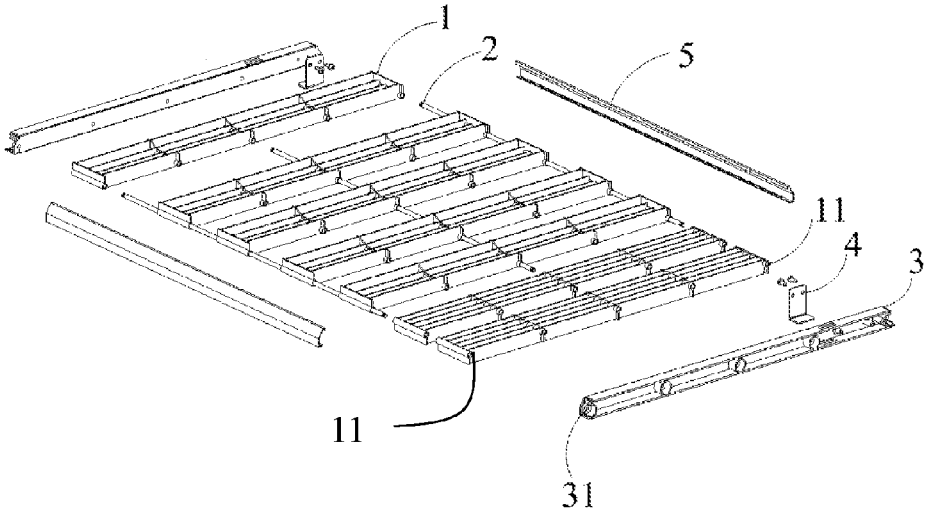
FIG. 5 is a structure schematic view of the combined shelf structure of embodiment 2 in assembling.
Figure 6:
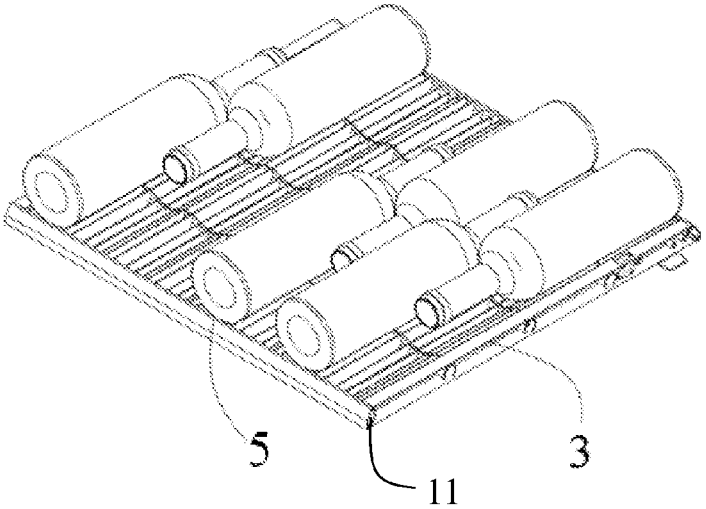
FIG. 6 is a structure schematic view of the assembled combined shelf structure with wine bottles placed horizontally.
Figure 7:
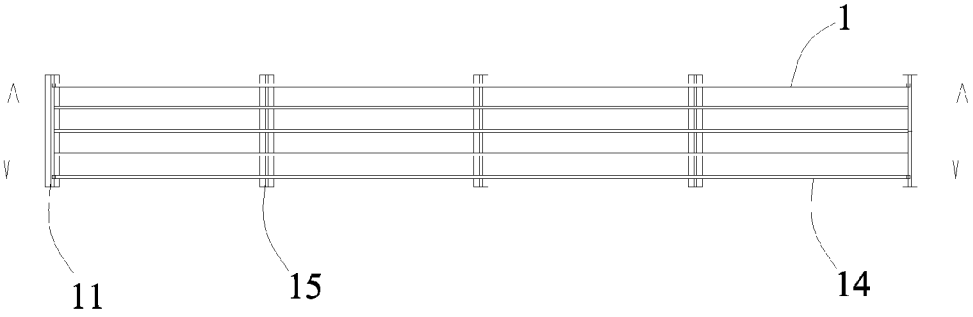
FIG. 7 is a structure schematic view of the shelf body of embodiment 2.
Figure 8:
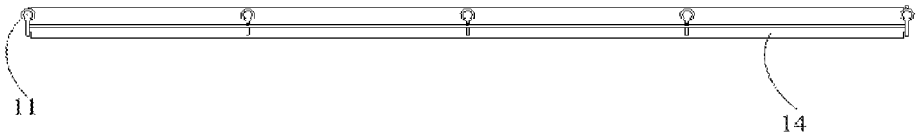
FIG. 8 is a schematic view seen from the line A-A direction of FIG. 7.
Figure 9:
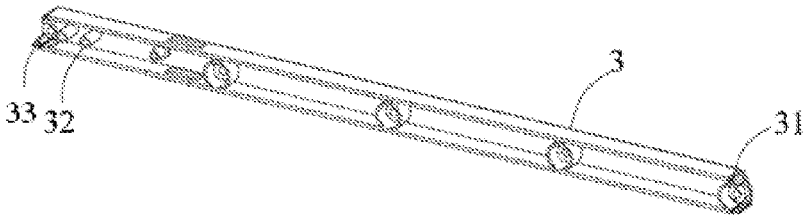
FIG. 9 is a structure schematic view of the guide rail of embodiment 2.
Figure 10:
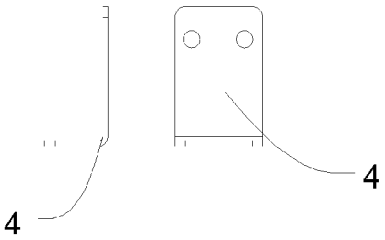
FIG. 10 is a structure schematic view of the stop block of embodiment 2.
Figure 11:
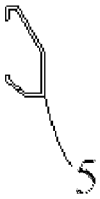
FIG. 11 is a structure schematic view of the cross-section of the snap-strip structure in embodiment 2.
Figure 12:
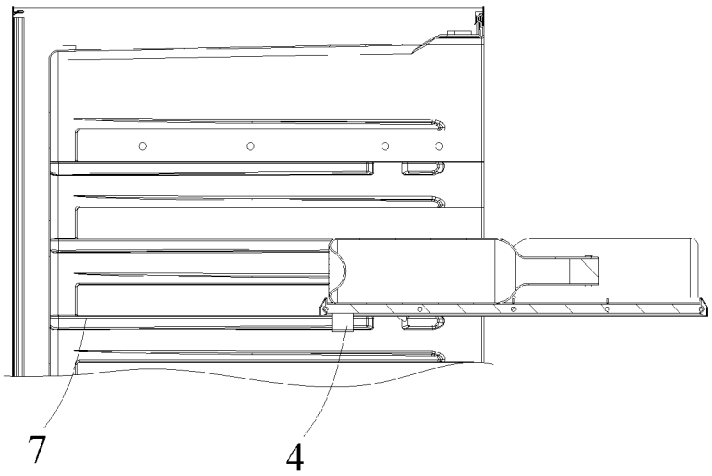
FIG. 12 is a structure schematic view illustrating the matching manner in which the combined shelf structure is arranged in a wine refrigerator

An embodiment of the combined shelf structure of the present disclosure is shown in FIG. 2, FIG. 3, and FIG. 4.

As is shown in FIG. 2, the shelf structure comprises at least two shelf bodies 1 and at least two carrier bars 2. Connecting holes 11 through which the carrier bars 2 pass are respectively provided at both ends of the shelf body 1.

Seven shelf bodies 1 and two carrier bars 2 are provided in this embodiment, in which the two carrier bars 2 respectively pass through the connecting holes 11 provided at both ends of the seven shelf bodies 1. Arranging the combined shelf structure into a wine refrigerator can satisfy the need for the placements of objects.

Additionally, grooves 12 which are matched with the sides of wine bottles may be provided on either the top surface or the bottom surface of the shelf body 1. The remaining surface is a flat structure 13 which is used for vertical placement of the wine bottles or other beverage bottles. The arrangement of grooves 12 is for the convenient horizontal placement of bottles so as to prevent them from rolling. The arrangement of flat structure 13 is for the convenient placement of the shelf structures positioned in different layers in a wine refrigerator as needed, and providing a structure for the vertical placement of the wind bottles or other beverage bottles. With the different arrangements of the top surface and the bottom surface of the shelf body 1, selections are provided for the horizontal or vertical placements of wine bottles and other canned or bottled drinks. The two connecting holes 11 provided at both ends of the shelf body 1 through which the carrier bars 2 pass enables the shelf body 1 to be suspended on the carrier bars 2 through the connecting holes 11, and the shelf bodies are easy to be disassembled and convenient to be arranged in a reasonable way according to the real placement requirements for objects. The number of shelf bodies 1 in the combined shelf structure is variable, and shelf structures to be put into a wine refrigerator are combined as needed by shelf bodies 1 with different widths, hence, the combined shelf structure is more human-friendly. In this embodiment, the top surface of the shelf body 1 forms a supporting surface. The shelf bodies 1 comprise shelf bodies with concave top surfaces and shelf bodies with flat bottom surfaces which are all used for receiving wine bottles horizontally. The shelf bodies 1 also could be provided with shelf bodies with concave bottom surfaces and shelf bodies with flat top surfaces which are used for the vertical placement of wine bottles or other objects. Of course, the shelf bodies 1 also could be randomly provided with part of them having convex top surfaces and concave bottom surfaces, thus it is capable of satisfying the requirements of vertical placement and horizontal placement at the same time.

Of course, preferably, another carrier bar 2 passing through the middle part of the seven shelf bodies 1 is also provided. Preferably, the above another carrier bar 2 passes through the connecting holes 11 at the geometric center of the shelf bodies 1. The configuration that three carrier bars 2 pass through the seven shelf bodies 1 enables the shelf bodies 1 to be suspended on the carrier bars 2 stably.

The shape of each connecting hole 11 is matched with the shape and size of the carrier bar 2. Preferably, the size of the connecting hole 11 is slightly larger than the size of the cross section of the carrier bar 2. The shapes of the connecting holes 11 and the cross section of the carrier bar 2 are not limited, but round shapes are preferable, which would facilitate the relative movements between the carrier bar 2 and the shelf body 1.

The embodiment further provides a refrigeration equipment which could be a refrigerator, a storage freezer or a wine refrigerator and the like. The refrigeration equipment is provided with the above combined shelf structure. The refrigeration equipment cooperates with the shelf structures in the manner to be described hereinafter: By hanging the shelf structure onto the two opposite inner walls or shelf-supporting ledges of a refrigerating chamber by carrier bars 2 which pass through the ends and middle part of several shelf bodies 1, the shelf structure therefore is stably arranged in the refrigerating chamber. The lengths of the carrier bars 2 are matched with the distance between the two opposite inner walls of the refrigerating chamber.

Embodiment 2

As is shown in FIG. 3 to FIG. 12, the embodiment is similar to embodiment 1. The difference is that several shelf bodies 1 are arranged along the carrier bars 2. The carrier bar 2 comprises a shelf body assembly section and fixing sections which are provided at both ends of the shelf body assembly section. The shelf body 1 is provided at the shelf body assembly section. The maximum value of the sum of width of the shelf bodies 1 along the direction of the carrier bars is less than the length of the shelf body assembly section. The configuration that the maximum value of the sum of width of the shelf bodies 1 along the direction of the carrier bars is less than the length of the shelf body assembly section has the effects as follows: the several shelf bodies 1 which are arranged at the shelf body assembly section of the carrier bar 2 could move along the shelf body assembly section, and therefore the shelf bodies 1 neighboring with each other are arranged with intervals, so that the shelf bodies 1 can be moved as needed and the distance between any two neighboring shelf bodies 1 could be adjusted for realizing the placement of wine bottles and other canned or bottled drinks having different sizes, accordingly, the effect that using the fewest number of shelf bodies 1 for holding the most wine bottles or other objects can be achieved. Preferably, the distance between any two neighboring shelf bodies 1 corresponds to the minimum gap between two wine bottles placed horizontally. When placing wine bottles horizontally, the requirement for the distance between wine bottles is hard to be satisfied because on one hand, a narrow gap may be very inconvenient for the horizontal placement of wine bottles, but on the other hand, a wide gap may be wasteful in space and also increases the risk of falling down. Hence, such an arrangement may reduce the number of shelf bodies 1, and meanwhile ensure the stability for placing wine bottles.

Further, the combined shelf structure comprises two guide rails 3. The guide rails 3 are connected with the fixing sections of the carrier bars 2. The shelf bodies 1 are positioned between the two guide rails 3. The two guide rails 3 are respectively arranged on the opposite inner side walls of a wine refrigerator. With the configuration that guide rails 3 are connected with the fixing sections of the carrier bars 2 and arranged on the opposite inner side walls of a wine refrigerator, the shelf structure can slide along the guide rails 3 freely, so that the combined shelf structure is easy to move in the wine refrigerator. Preferably, in this embodiment, the guide rails 3 are in slidable connection with the wine refrigerator, thus it is convenient for people to pull the combined shelf structure out of the wine refrigerator or push it in to take wine bottles out or put them in. The connection manners between the guide rails 3 and the carrier bars 2 are various. Preferably, assembling holes 31 which are used for connecting with the carrier bars 2 are provided at both ends of the guide rails 3, and the guide rails 3 pass through the assembling holes 31 and connect with the guide rails 3. The matching of the combined shelf structure and the liner of the refrigerating chamber can be achieved by installing the shelf structure on supporting ledges on the opposite side walls of the liner of the refrigeration equipment by guide rails 3. The combined shelf structure may slide along the supporting ledges by means of the guide rails 3, thereby achieving the effect that the shelf structure can move freely in the refrigeration equipment. To be clarified, the guide rails 3 are not a necessary part of the combined shelf structure except for this embodiment, and the matching of the shelf structure and the liner of the refrigeration equipment can be achieved by directly suspending the shelf body assembly section of the carrier bar 2 on the liner or placing the shelf body assembly section on the supporting ledges of the liner.

Additionally, the combined shelf structure further comprises stop blocks 4 which are used for preventing the combined shelf structure from tipping over. The stop blocks 4 are arranged on the supporting ledges on the opposite side walls of the wine refrigerator. The stop blocks 4 are fixedly connected with the guide rails 3. The connection and matching of the stop blocks 4 and the supporting ledges 7 inside the wine refrigerator can improve the stability for placing the guide rails 3 on the supporting ledges 7 and prevent the shelf structure from tipping over. Preferably, the guide rails 3 are provided with screw studs 32, and the stop blocks 4 are connected with the screw studs 32 on the guide rails 3.

In this embodiment, the combined shelf structure further comprises two snap-strip structures 5. Both ends of each guide rail 3 are provided with grooves fitted with the snap-strip structures 5. The two snap-strip structures 5 are positioned between two opposite guide rails 3 and arranged at both ends of the shelf bodies 1. The primary function of the snap-strip structure 5 is to decorate to improve the aesthetics, and meanwhile the connection between the snap-strip structure 5 and the guide rails 3 can enhance the connection reliability of the entire combined shelf structure.

In this embodiment, the supporting surfaces are formed on the top surfaces of several shelf bodies 1. The shelf bodies 1 include shelf bodies 1 with concave top surfaces and shelf bodies 1 with flat top surfaces. This arrangement enables the effect that either the top surface or the bottom surface can be used as the supporting surface for receiving wine bottles horizontally or for the vertical placement of other canned or bottled drinks.

Additionally, the shelf body 1 is consisted of several carrying units and connecting units. The connecting units are arranged on the carrying units, and connecting holes 11 are provided on the connecting units. Several carrying units are connected in parallel by the connecting units and the connecting units are perpendicularly connected with the carrying units. Preferably, the carrying units are division bars 14 and the connecting units are ribs 15, and the connecting holes 11 are provided on the ribs 15. Several division bars 14 are connected in parallel by the ribs 15 and the division bars 14 are perpendicularly connected with the ribs 15. Besides, in other embodiments, the carrying units may be common plate-shaped structures, and the connecting units may be snap joints and thread structures which could connect several plate-shaped structures together. Alternatively, the carrying units are plate-shaped structures with hooks and the connecting units are rod-shaped or tube-shaped structures, and the plate-shaped structures are suspended on the rod-shaped or tube-shaped structure by the hooks.

Preferably, the width value of the shelf body 1 is consistent with the diameter of a wine bottle. The distance between two neighboring division bars 14 ranges from 10 mm to 12 mm. Five division bars 14 and five ribs 15 are provided in this embodiment. The shelf body 1 is formed by welding the five division bars 14 and five ribs 15 together or shaping them in one piece. The arrangement that the distance between two neighboring division bars 14 is in the range from 10 mm to 12 mm is aimed at, when wine bottles or other beverage bottles are placed on the flat structure 13 of a shelf body 1 vertically, preventing them from tilting due to the suffered imbalanced forces in the vertical direction caused by an overly large gap between the two neighboring division bars 14; or aimed at avoiding poor performance in air permeability or the increase of division bars 14 due to overly small distance between the two neighboring division bars 14. In this embodiment, the division bar 14 is a strip-like structure, and the widths of the several division bars 14 are different. The widths of the division bars on the shelf body sequentially decrease from both the left and right ends to the middle part. The several division bars 14 are connected together by the ribs 15, and the division bars on one side of the shelf body are level with each other so as to form the flat structure 13. The division bars on the other side form the groove 12 due to the fact that the widths of the division bars on the shelf body decrease from both the left and right ends to the middle part.

It can be understood that the different embodiments above can be mixed to generate new embodiments. The new embodiments should also be regarded as part of the disclosure, and also should be in the scope of present invention.

Compared with the prior art, the beneficial effects achieved by the above one or more embodiments are:

In the combined shelf structure of the present disclosure, either the top surface or the bottom surface of the shelf body is provided with grooves matching with the sides of wine bottles, the remaining surface is provided with a flat structure for the vertical placement of wine bottles or other beverage bottles. The setting of the shelf body having a top surface and a bottom surface which is different from the top surface provides choices to users for the horizontal or vertical placements of wine bottles and other canned or bottled drinks. Connecting holes through which two carrier bars pass are arranged at both ends of the shelf body, and the shelf bodies are suspended on the carrier bars by the connecting holes, so that the shelf bodies are easy to be disassembled and convenient to be arranged in a reasonable way according to the real placement requirements for objects. The number of shelf bodies in the combined shelf structure is variable, so as to form shelf structures to be placed in a wine refrigerator with different widths, hence, the combined shelf structure is more human-friendly.

Obviously, the foregoing exemplary embodiments of the invention has been presented only for the purpose of giving examples to clearly illustrate and describe the invention, which is not intended to limit the invention to the precise embodiments disclosed. Modifications and variations based on the invention could be developed by the skilled in the art. Therefore, it would be impossible and unnecessary to describe all embodiments here. Any modifications, substitutions and improvements made within the spirits and principles of the present invention should be included within the protection scope of the claims of the present invention.

What is claimed is:

1. A modular shelf structure for storing wine bottles, comprising at least two shelf bodies and at least two carrier bars; connecting holes through which the carrier bars pass are respectively arranged at both ends of each shelf body; either a top surface or a bottom surface of each shelf body is a concaved surface corresponding to the shape of a wine bottle, and the remaining surface is provided with a flat structure; the carrier bars pass through the connecting holes of each of the shelf bodies; wherein the modular shelf structure is configurable to three arrangements:

a first arrangement in which a first shelf body of the at least two shelf bodies is arranged to have their corresponding concaved surface as the top surface so a wine bottle can lay horizontal on the concaved surface without rolling; and a second adjacent shelf body of the at least two shelf bodies is arranged to have their corresponding flat structure as the top surface so a wine bottle can be stored in an vertical upright position on the flat structure, wherein the number of shelf bodies having a concaved top surface and the number of shelf bodies having a flat structure top surface are adjustable when the least two shelf bodies are mounted on the carrier bars via the respective connecting holes, a second arrangement in which all of the shelf bodies are arranged to have their corresponding concaved surface as the top surface so a wine bottle can lay horizontal on the concaved surface without rolling, and a third arrangement in which all of the shelf bodies are arranged to have their corresponding flat structure as the top surface so a wine bottle can be stored in a vertical upright position on the flat structure.

2. The modular shelf structure according to claim 1, wherein the at least two shelf bodies are arranged along the carrier bars; each carrier bar comprises a shelf body assembly section and fixing sections which are respectively provided at both ends of the shelf body assembly section; the shelf bodies are provided at the shelf body assembly section, the maximum value of the sum of width of the shelf bodies along the direction of the carrier bars is less than the length of the shelf body assembly section; and wherein each top surface of the respective shelf bodies is formed from a plurality of division bars which span between the both ends; wherein a plurality of ribs extend from the bottom surface of each shelf body to the respective top surface; wherein corresponding division bars are each perpendicular mounted to two corresponding opposing ribs.

3. The modular shelf structure according to claim 2, further comprising two opposing slidable guide rails which are connected with the fixing sections of the carrier bars; each shelf body is positioned between the two opposing slidable guide rails and the two opposing slidable guide rails are respectively arranged on two opposite side walls in a wine refrigerator so the modular shelf can slide in and out of the wine refrigerator.

4. The modular shelf structure according to claim 1, wherein each shelf body comprises a plurality of carrying units and a plurality of connecting units, the connecting units are arranged on the carrying units, and the connecting holes are arranged on the connecting units.

5. The modular shelf structure according to claim 4, wherein the carrying units are division bars and the connecting units are ribs, and the connecting holes are arranged on the ribs.

6. The modular shelf structure according to claim 3, further comprising stop blocks for preventing the shelf structure from tipping over, the stop blocks are arranged on supporting ledges on opposite side walls of the wine refrigerator, and the stop blocks are fixedly connected with the guide rails.

7. The modular shelf structure according to claim 3, wherein the shelf structure further comprises two snap-strip structures, both ends of each guide rail are provided with grooves snap-fitted with the snap-strip structures, the two snap-strip structures are arranged between the two opposite guide rails and positioned at both ends of each shelf body.

8. The modular shelf structure according to claim 3, further comprising assembling holes used for connecting with the carrier bars are respectively provided at both ends of the guide rails, and the carrier bars passes through the assembling holes and are connected with the guide rails.

9. Refrigeration equipment for cooling wine bottles comprising a modular shelf structure arranged in the refrigeration equipment, wherein the shelf structure is configured to store wine bottles; wherein the shelf structure comprises at least two shelf bodies and at least two carrier bars; connecting holes through which the carrier bars pass are respectively arranged at both ends of each shelf body; either a top surface or a bottom surface of each shelf body is a concaved surface corresponding to the shape of a wine bottle, and the remaining surface is provided with a flat structure; the carrier bars pass through the connecting holes of each of the shelf bodies; and wherein the modular shelf structure is configurable to three arrangements:

a first arrangement in which a first shelf body of the shelf bodies is arranged to have their corresponding concaved surface as the top surface so a wine bottle can lay horizontal on the concaved surface without rolling; and a second adjacent shelf body is arranged to have their corresponding flat structure as the top surface so a wine bottle can be stored in an vertical upright position on the flat structure, wherein the number of shelf bodies having a concaved the top surface and the number of shelf bodies having a flat structure top surface are adjustable when the at least two shelf bodies are mounted on the carrier bars via the respective connecting holes, a second arrangement in which all of the shelf bodies are arranged to have their corresponding concaved surface as the top surface so a wine bottle can lay horizontal on the concaved surface without rolling, and a third arrangement in which all of the shelf bodies are arranged to have their corresponding flat structure as the top surface so a wine bottle can be stored in a vertical upright position on the flat structure.

10. The refrigerator equipment according to claim 9, wherein the at least two shelf bodies are arranged along the carrier bars; each carrier bar comprises a shelf body assembly section and fixing sections which are respectively provided at both ends of the shelf body assembly section; the at least two shelf bodies are provided at the shelf body assembly section, the maximum value of the sum of width of the shelf bodies along the direction of the carrier bars is less than the length of the shelf body assembly section and wherein each top surface of the respective shelf bodies is formed from a plurality of division bars which span between the opposing side walls; wherein a plurality of ribs extend from the bottom surface of each shelf body to the respective top surface; wherein corresponding division bars are each perpendicular mounted to two corresponding opposing ribs.

11. The refrigerator equipment according to claim 10, wherein the shelf structure comprises two opposing slidable guide rails which are connected with the fixing sections of the carrier bars; each shelf body is positioned between the two opposing slidable guide rails and the two opposing slidable guide rails are respectively arranged on two opposite side walls in a wine refrigerator, so the modular shelf can slide in and out of the wine refrigerator.

12. The refrigerator equipment according to claim 9, wherein each shelf body comprises several carrying units and several connecting units, the connecting units are arranged on the carrying units, and the connecting holes are arranged on the connecting units.

13. The refrigerator equipment according to claim 12, wherein the carrying units are division bars and the connecting units are ribs, and the connecting holes are arranged on the ribs.

14. The refrigerator equipment according to claim 11, wherein the shelf structure further comprises stop blocks for preventing the shelf structure from tipping over, the stop blocks are arranged on supporting ledges on opposite side walls of the wine refrigerator, and the stop blocks are fixedly connected with the guide rails.

15. The refrigerator equipment according to claim 11, wherein the shelf structure further comprises two snap-strip structures, both ends of each guide rail are provided with grooves snap-fitted with the snap-strip structures, the two snap-strip structures are arranged between the two opposite guide rails and positioned at both ends of the shelf body.

16. The refrigerator equipment according to claim 11, wherein assembling holes used for connecting with the carrier bars are respectively provided at both ends of the guide rails, and the carrier bar passes through the assembling holes and is connected with guide rails.

* * * * *